US008157579B2

(12) United States Patent
Wu

(10) Patent No.: US 8,157,579 B2
(45) Date of Patent: Apr. 17, 2012

(54) ELECTRICAL CONNECTOR ASSEMBLY HAVING ENGAGING MEANS FOR PROVIDING HOLDING FORCE

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/181,731

(22) Filed: Jul. 13, 2011

(65) Prior Publication Data

US 2012/0015544 A1 Jan. 19, 2012

(30) Foreign Application Priority Data

Jul. 13, 2010 (CN) ..... 201010225097

(51) Int. Cl.
*H01R 13/627* (2006.01)

(52) U.S. Cl. ..... 439/352

(58) Field of Classification Search ..... 439/352, 439/358, 350, 357, 488
See application file for complete search history.

(56) References Cited

U.S. PATENT DOCUMENTS

| | | | | |
|---|---|---|---|---|
| 7,281,937 | B2 | 10/2007 | Reed et al. | |
| 7,581,978 | B1 | 9/2009 | Briant | |
| 2009/0246998 | A1* | 10/2009 | Wu | 439/352 |
| 2009/0247017 | A1* | 10/2009 | Wu | 439/660 |
| 2009/0253292 | A1* | 10/2009 | Wu | 439/493 |
| 2010/0317218 | A1* | 12/2010 | Wu | 439/352 |
| 2011/0005825 | A1* | 1/2011 | Wu | 174/359 |
| 2011/0280528 | A1* | 11/2011 | Wu | 385/101 |
| 2011/0281455 | A1* | 11/2011 | Wu | 439/345 |

* cited by examiner

*Primary Examiner* — Tulsidas C Patel
*Assistant Examiner* — Phuongchi Nguyen
(74) *Attorney, Agent, or Firm* — Wei Te Chung; Andrew C. Cheng; Ming Chieh Chang

(57) ABSTRACT

An electrical connector assembly (100) comprises: a housing (1) comprising a first shield part (15), a second shield part (16) assembled with each other; at least one printed circuit board (2) disposed in the housing; a strain relief (5) disposed in the housing and sandwiched by the first shield part and the second shield part; a metallic shell (8) engaged with the housing; a pair of first screws (91) assembled to the housing along two opposite directions and interlocked with first shield part, the second shield part and the strain relief; and a pair of second screws (92) assembled to the housing along a same direction and interlocked the first shield part, the second shield part, the strain relief and the metallic shell.

19 Claims, 14 Drawing Sheets

ELECTRICAL CONNECTOR ASSEMBLY HAVING ENGAGING MEANS FOR PROVIDING HOLDING FORCE

FIELD OF THE INVENTION

The present invention generally relates to connectors suitable for transmitting data, more specifically to input/output (I/O) connectors with high-density configuration and high data transmitting rate.

DESCRIPTION OF PRIOR ART

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O plug-style connectors and this is difficult to do without increasing the width of the connectors. Increasing the width of the plug connectors leads to difficulty in fitting the plug into standard width routers and/or servers, and would require a user to purchase non-standard equipment to accommodate the wider plug converters. As with any connector, it is desirable to provide a reliable latching mechanism to latch the plug connector to an external housing to maintain the mated plug and receptacle connectors together modifying the size and/or configuration the connector housing may result in a poor support for a latching mechanism. Latching mechanisms need to be supported reliably on connector housings in order to effect multiple mating cycles. Accordingly, certain individuals would appreciate a higher density connector that does not have increased width dimensions and which has a reliable latching mechanism associated therewith.

And, I/O connector has a housing and a strain relief assembled with other. And, the housing comprises a first shield part and a second shield part. However, the engagement between the first shield part, the second shield part and the strain relief will not be easily achieved.

As discussed above, an improved electrical connector overcoming the shortages of existing technology is needed.

SUMMARY OF THE INVENTION

Accordingly, an object of the present invention is to provide an electrical connector assembly having engaging means for providing holding force.

In order to achieve the above-mentioned objects, an electrical connector assembly, comprises: a housing having therein at least three receiving rooms extending along a front-to-rear direction and communicating with an exterior; two printed circuit boards received into each of receiving room and positioned in the housing; a strain relief disposed in the housing; a latch mechanism assembled to an exterior surface of the housing; and engaging means assembled to the housing along a vertical direction to interlock the strain relief to the housing.

Other objects, features and advantages of the invention will be apparent from the following detailed description taken in connection with the accompanying drawings.

DETAILED DESCRIPTION OF PREFERRED EMBODIMENTS

Figure 1:
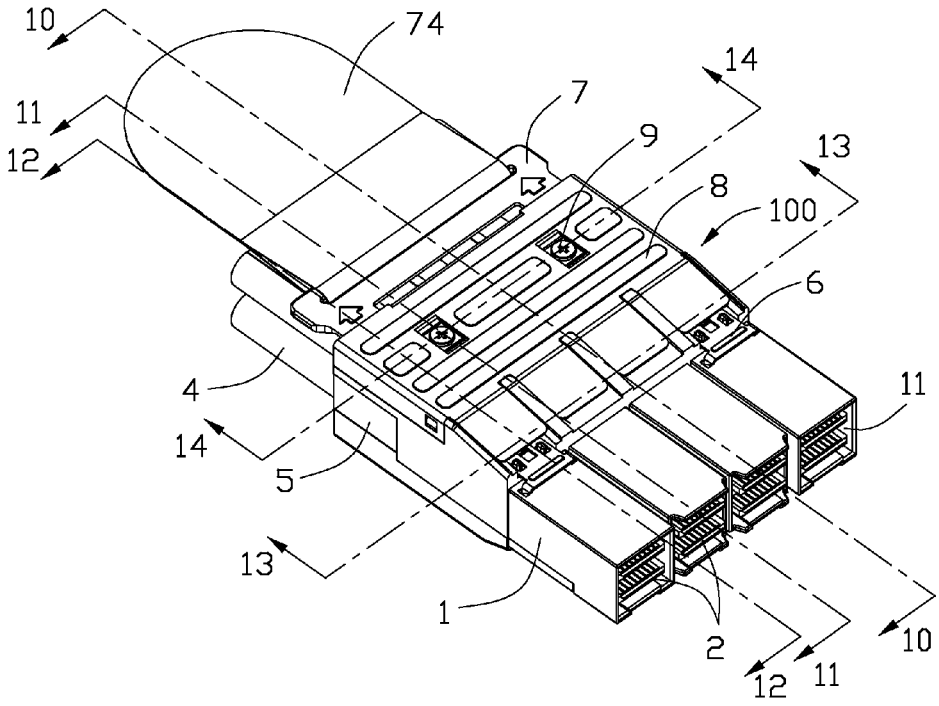
FIG. 1 is a perspective view of an electrical connector assembly in accordance with the present invention.

Reference will now be made to the drawing figures to describe the present invention in detail.

Figure 2:
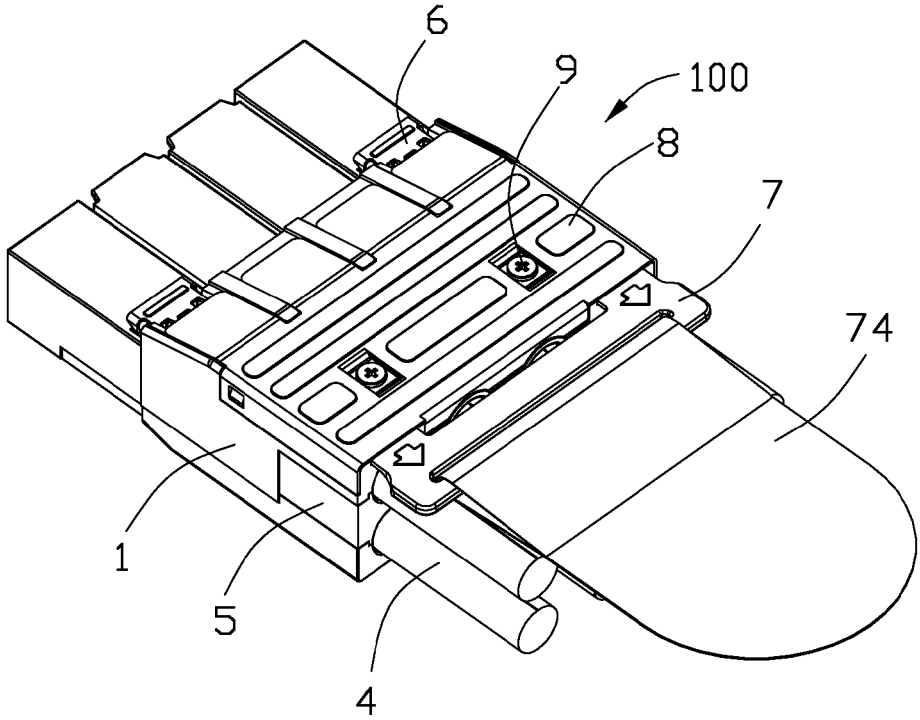
FIG. 2 is another perspective view of the electrical connector assembly of FIG. 1.
Figure 3:
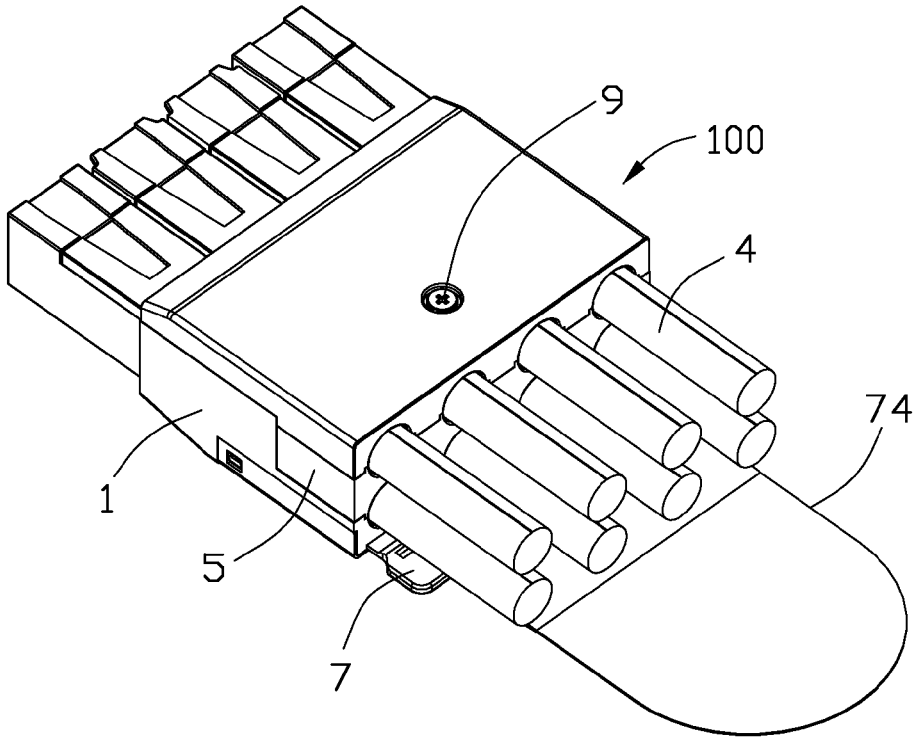
FIG. 3 is another perspective view of the electrical connector assembly of FIG. 2.

FIGS. 1 to 3 illustrate perspective views of an electrical connector assembly 100 made in accordance with the present invention. And referring to FIGS. 4 to 9, the electrical connector assembly 100 comprises a housing 1 having four receiving rooms 11 formed therein and spaced apart with each other. Eight printed circuit boards (PCBs) 2 are disposed in the housing 1. And, each of two printed circuit boards (PCBs) 2 are received into a receiving room 11 of the housing 1. Four spacers 2 are disposed in the housing 1. Each of spacer 2 is received into a corresponding receiving room 11 and sandwiched by two PCBs 2. Eight cables 4 are respectively electrically connected with eight printed circuit boards 2. A strain relief 5 is disposed in a rear end of the housing 1. Engaging means 9 are assembled to the housing 1 along a vertical direction and interconnected the strain relief 5 to the housing 1. The electrical connector assembly 100 further comprises a latch mechanism assembled to an exterior surface of the housing 1 and a metallic shell 8 shielding a portion of the housing 1 and the latch mechanism. The latch mechanism comprises a latching member 6 and a pulling member 7 interconnected with each other.

Referring to FIGS. 4 to 9, the housing 1 is made of metallic material and formed in a die-cast manner. The housing 1 defines a body portion 12 and a mating portion 13 extending forward from the body portion 12 for mating to a complementary connector (not shown). The body portion 12 has a cross section larger than that of mating portion 13. The mating portion 12 defines four rectangular mating ports. The housing 1 defines four receiving rooms 11 formed therein and respectively throughout the housing 1 along a front-to-rear direction. The four receiving rooms 11 are arranged side by side and spaced apart with each other. The body portion 12 of the housing 1 has a top surface defined as a first surface 121, the mating portion 13 of the housing 1 has a top surface defined as a second surface 131. The first surface 121 is disposed above the second surface 131. And, the first surface 121 defines an inclined surface toward to the second surface 131. The body portion 12 defines a pair of receiving cavities 14 extending downwardly from the inclined surface for a distance. A pair of supporting portions 141 are respectively formed on two inner side surfaces of each receiving cavity 14. The supporting portions 141 are used for supporting a portion of the pulling member 7. Two spaced slits 142 are respectively formed in back of each receiving cavity 14 and communicated with the receiving cavity 14. A pair of wedge-shaped projections 17 are formed on two sides of the body portion 12 of the housing 1 for engaging with the metallic shell 8.

Referring to FIGS. 4 to 14, the housing 1 comprises an upper shield part 15 and a lower shield part 16 assembled with each other. And, the upper shield part 15 defines four rectangular frames 151 formed on a front end thereof and spaced apart with each other. The upper shield part 15 defines a cutout 152 formed on a bottom side thereof and communicated with an exterior. A strain relief 5 is received into a rear end of the cutout 152. And, the cutout 152 of the upper shield part 15 is shielded by the lower shield part 16 along an up-to-down direction. In addition, the upper shield part 15 defines four passageways 153 communicated with an exterior through the cutout 152. Two semi-circular first positioning posts 154 are formed on an inner side surface of each passageway 153 for supporting the printed circuit board 2. Another two semi-circular first positioning posts 154 are formed on another inner side surface of each passageway 153 for supporting the printed circuit board 2. Two first positioning posts 154 are spaced apart with each other and arranged along a front-to-rear direction. And a second positioning post 155 is formed between two first positioning posts 154 for limiting a front-to-rear movement of the printed circuit board 2. It should be noted that the pair of receiving cavities 14 of the housing 1 are formed at two sides of a top surface of the upper shield part 15. The upper shield part 15 defines three through holes 156. The lower shield part 16 also defines a through hole 161 corresponding to a through hole 156 along an up-to-down direction and a pair of receiving holes 164 disposed at two sides of the through hole 161. The through hole 161 is alignment with a middle through hole 156 along an up-to-down direction. The pair of receiving holes 164 are in alignment with the two side holes 156. The pair of wedge-shaped projections 17 are formed on two sides of the upper shield part 15. The upper shield part 15 defines four grooves 157 formed on a bottom surface thereof and arranged along a transversal direction. And three positioning projections 158 are respectively formed between each of two adjacent grooves 157. The three through holes 156 are respectively located in front of the three positioning projections 158. The lower shield part 16 also defines four grooves 162 formed on a top surface thereof and arranged along a transversal direction. And three positioning projections 163 are respectively formed between each of two adjacent grooves 162. One through hole 161 and two receiving holes 164 are located in front of the three positioning projection 163. The positioning projections 158, 163 are used to achieve a cooperation between the strain relief 5 and the upper and lower shield part 15, 16.

Figure 8:
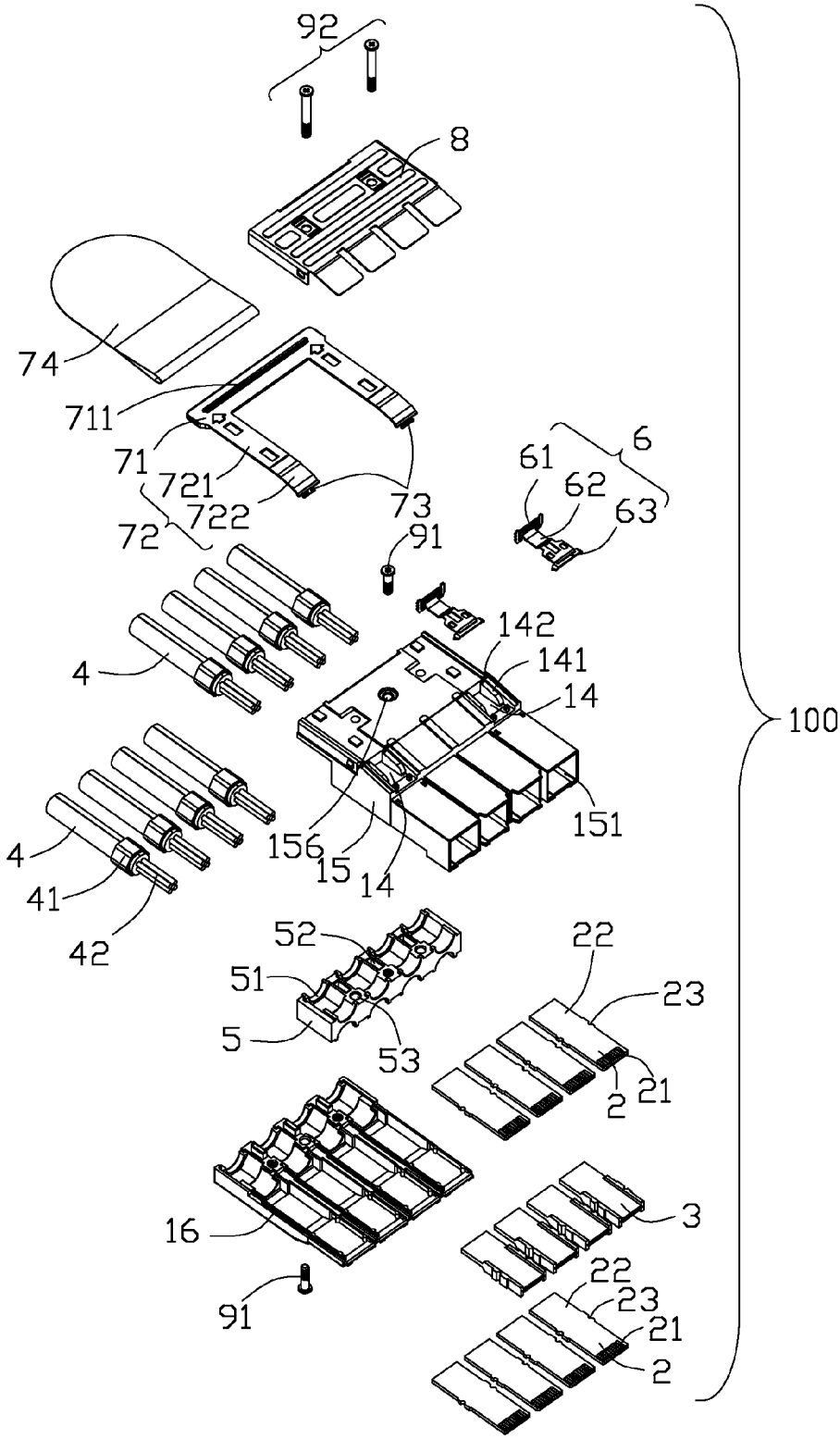
FIG. 8 is an exploded view of the electrical connector assembly of FIG. 1.
Figure 13:
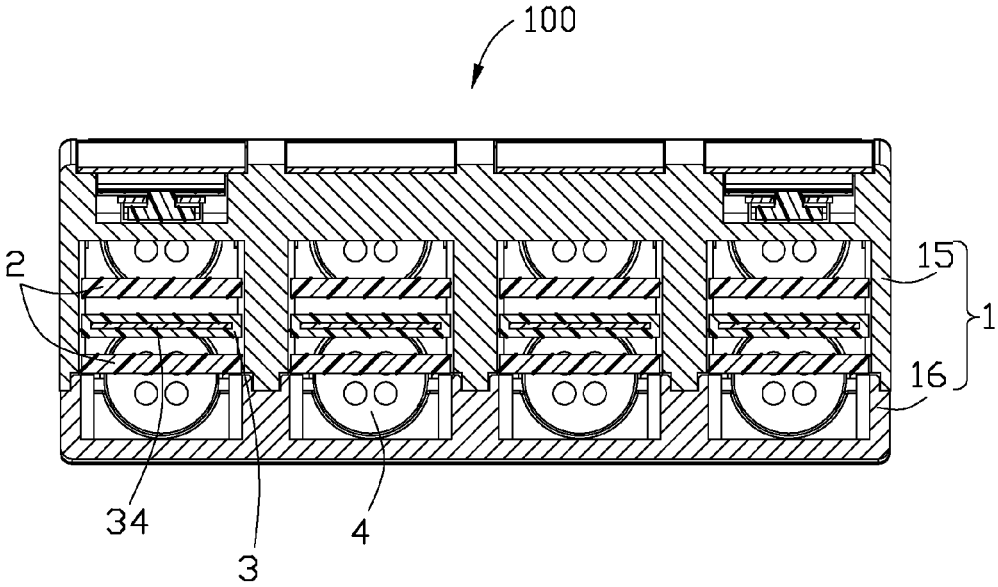
FIG. 13 is a cross section view of the electrical connector assembly of FIG. 1 taken along line 13-13.

Referring to FIG. 8 and in conjunction with FIG. 13, eight printed circuit boards 2 are disposed in the housing 1. Each of two printed circuit boards 2 are received into a receiving room 11. Each of the printed circuit board 2 has a mating section 21 formed on a front end thereof and a terminating section 22 formed on a rear end thereof Each of the printed circuit board 2 defines a pair of slots 23 formed on two lateral sides for cooperating with the pair of second positioning posts 155 of the upper shield part 15.

Figure 6:
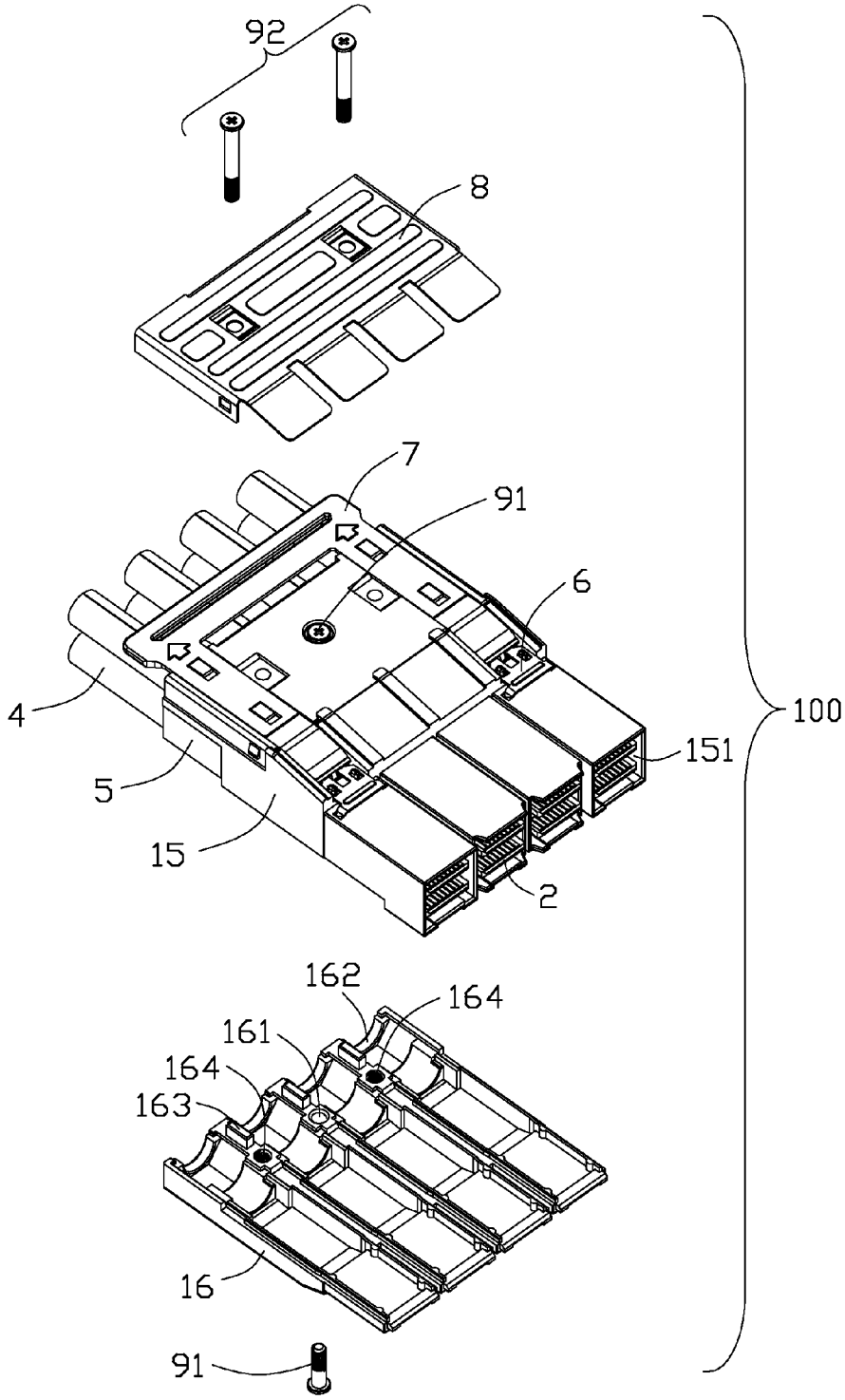
FIG. 6 is another partially assembled view of the electrical connector assembly of FIG. 1.
Figure 7:
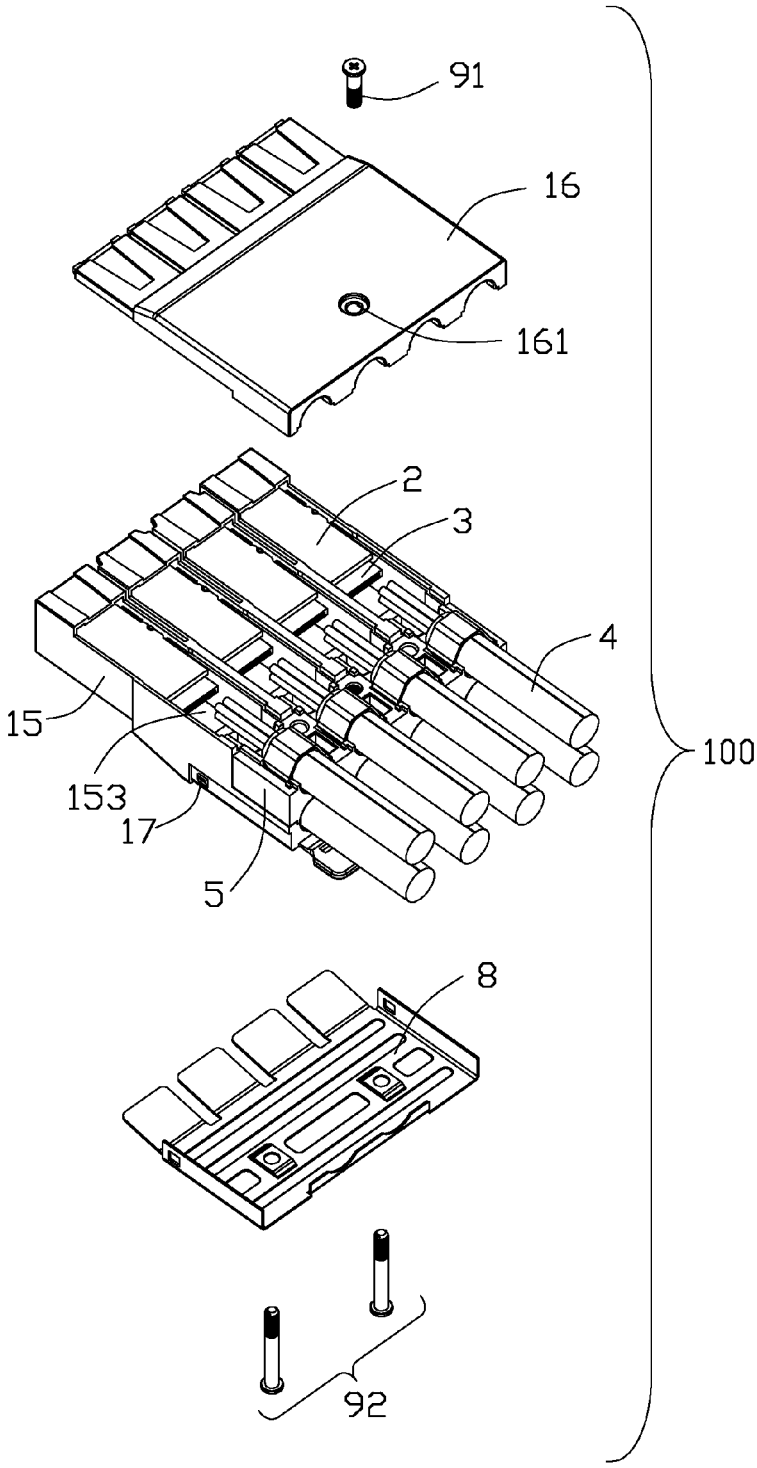
FIG. 7 is similar to FIG. 6, but viewed from another aspect.
Figure 10:
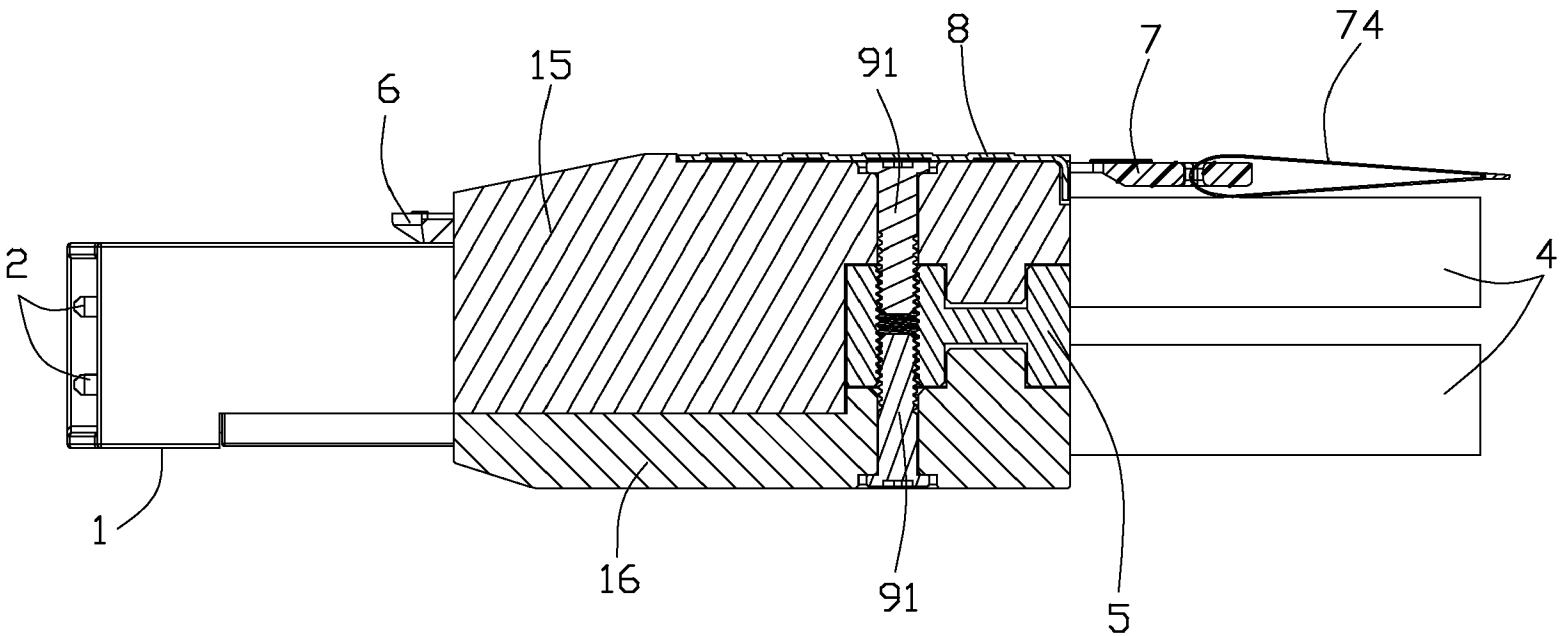
FIG. 10 is a cross section view of the electrical connector assembly of FIG. 1 taken along line 10-10.
Figure 11:
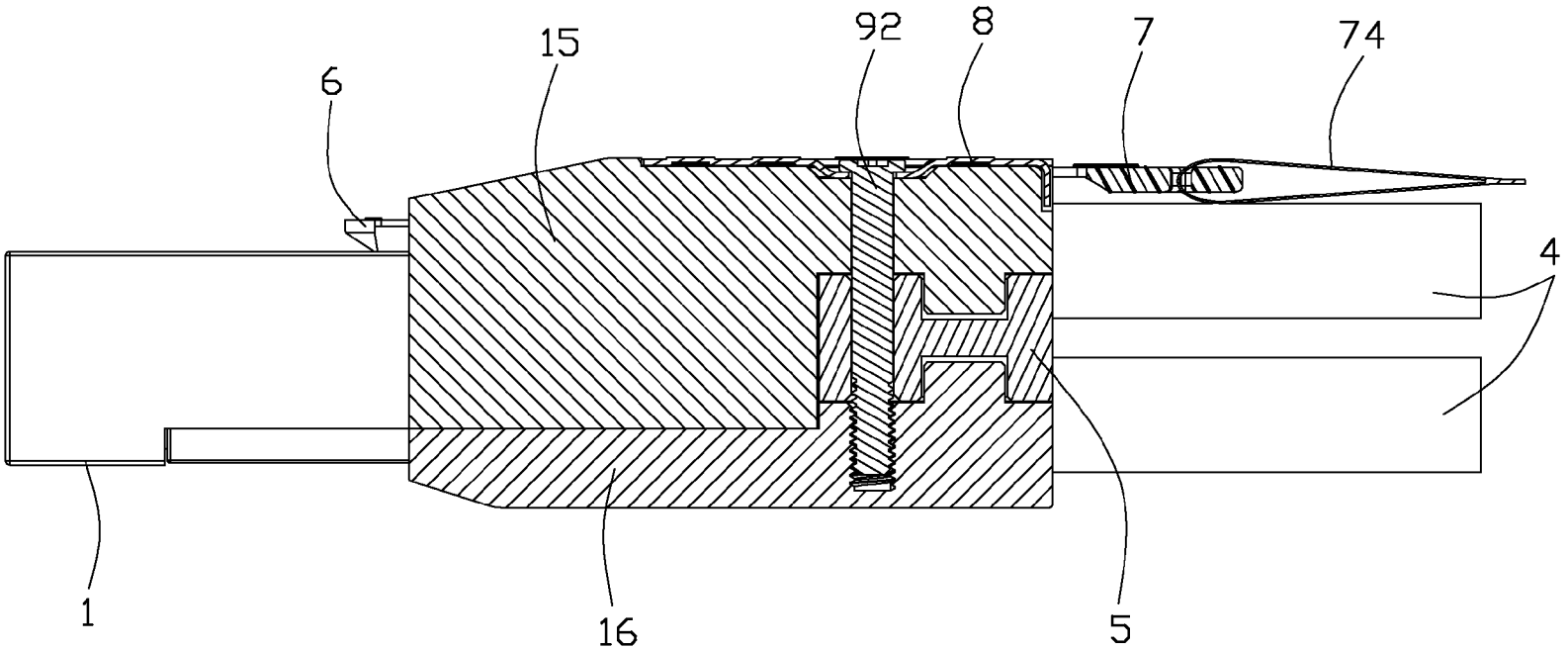
FIG. 11 is a cross section view of the electrical connector assembly of FIG. 1 taken along line 11-11.
Figure 12:
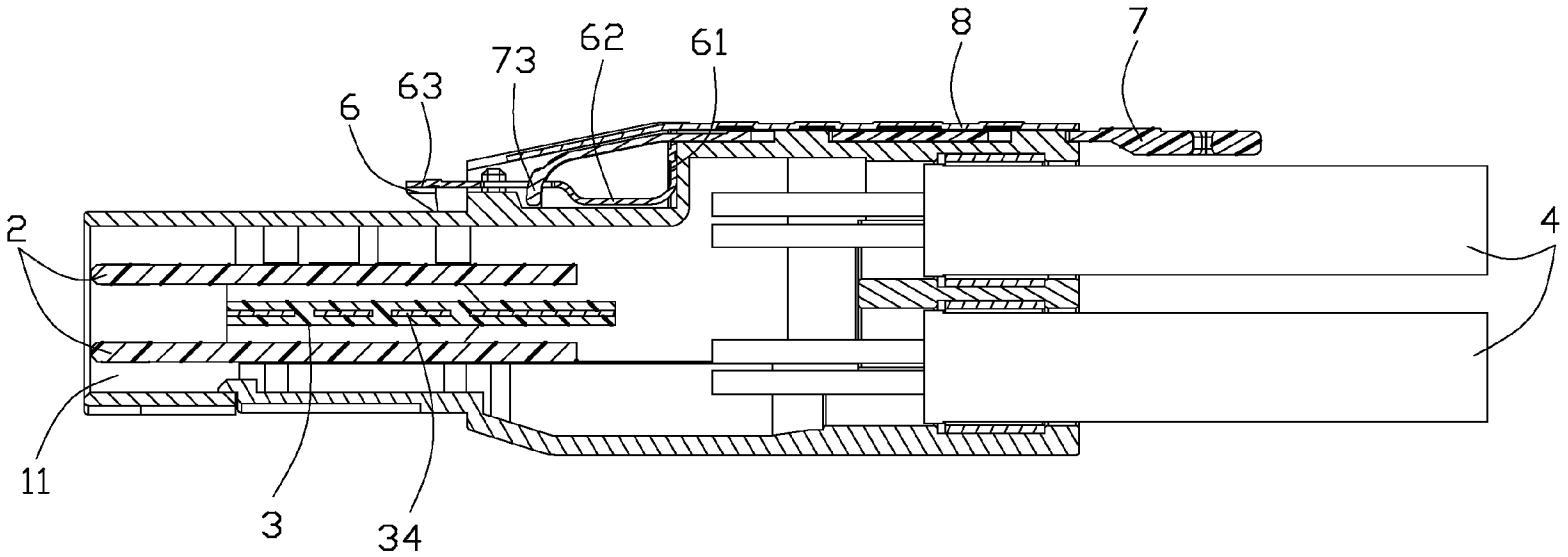
FIG. 12 is a cross section view of the electrical connector assembly of FIG. 1 taken along line 12-12.

Referring to FIGS. 6 to 7 and in conjunction with FIGS. 10 and 12, four spacers 3 are disposed in the housing 1. Each of the spacer 3 is formed of insulative material and sandwiched by two printed circuit boards 2 in a vertical direction. Each of the spacer 3 defines a pair of ribs 31 formed on a top surface thereof and another pair of ribs 32 formed on a bottom surface for supporting the printed circuit boards 2. The spacer 3 further defines a pair of grooves 33 respectively formed on two sides thereof and extending along a vertical direction for cooperating with two corresponding second positioning posts 155 formed in a receiving room 11 of the upper shield part 15. The spacer 3 further defines a grounding plate 34 integrative formed therein.

Referring to FIGS. 7 to 8 and in conjunction with FIG. 13, eight cables 4 are respectively electrically and mechanically connected with eight printed circuit boards 2. Each of the cable 4 has a plurality of conductors 41 formed therein and electrically connected to a terminating section 22 of the printed circuit board 2. A ring 42 is disposed at a front end of each cable 4 and surrounding a portion of the cable 4.

Figure 9:
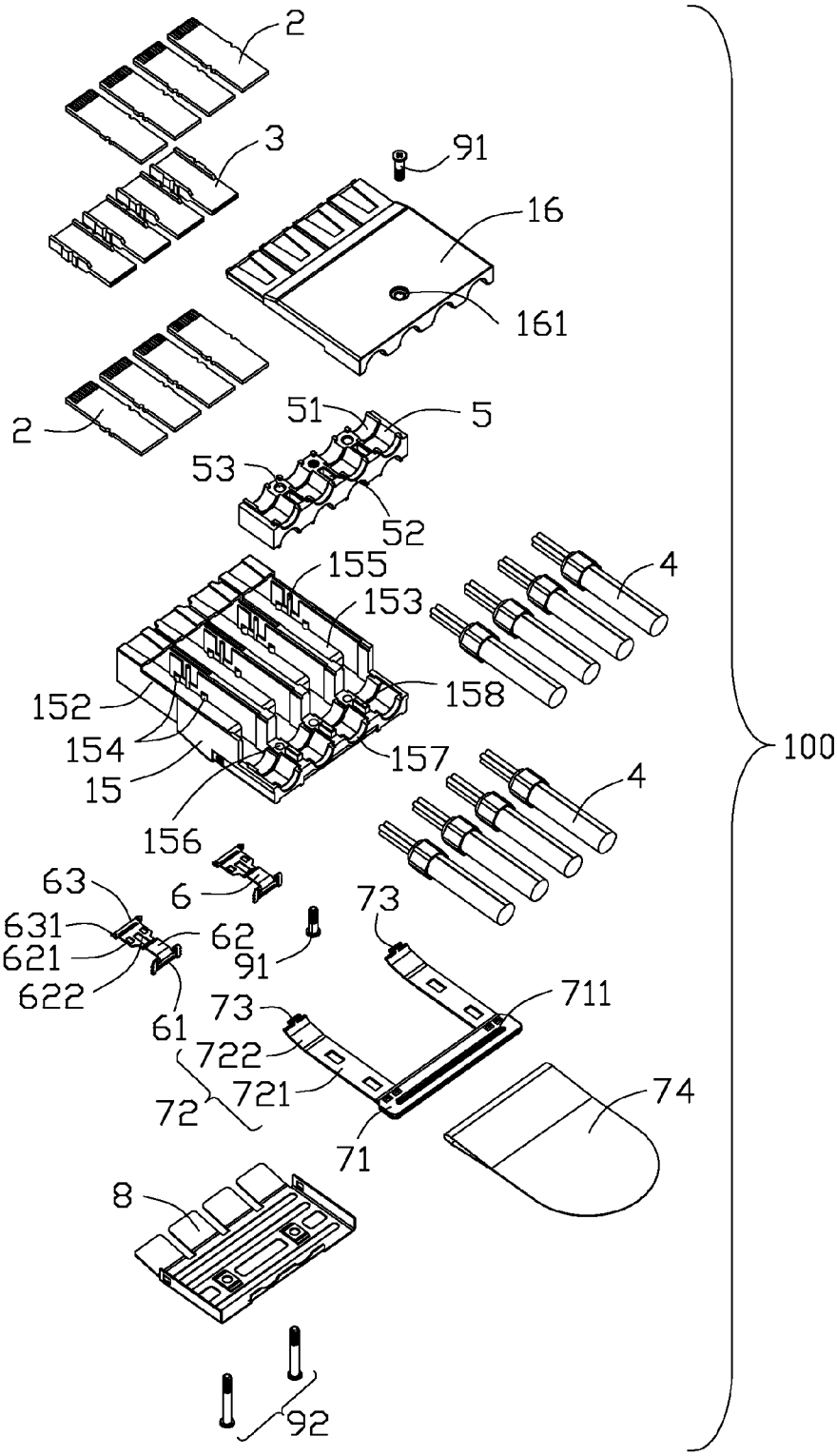
FIG. 9 is another exploded view of the electrical connector assembly of FIG. 8.
Figure 14:
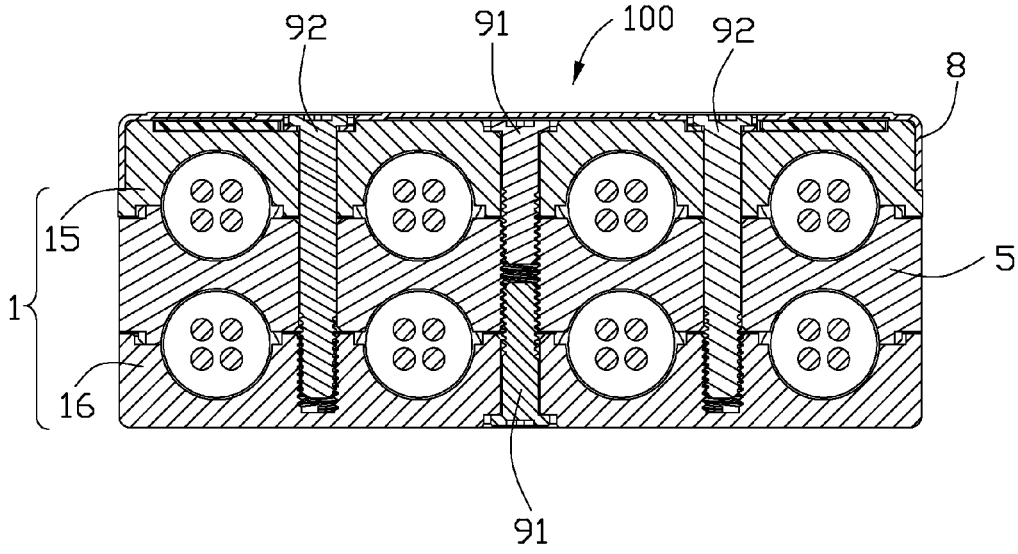
FIG. 14 is a cross section view of the electrical connector assembly of FIG. 1 taken along line 14-14.

Referring to FIGS. 8 to 10 and in conjunction with FIG. 14, a strain relief 5 is made of metallic material and disposed in a rear area of the receiving rooms 11 housing 1. The strain relief 5 has a width equal to the width of the housing 1. The strain relief 5 is sandwiched by the upper shield part 15 and the lower shield part 16. The strain relief 5 defines four recesses 51 formed on a top surface thereof and another four recesses 51 formed on a bottom surfaces thereof Four recesses 51 formed on the top surface of the strain relief 5 are corresponding to the four grooves 157 of the upper shield part 15, 16. Four recesses 51 formed on the bottom surface of the strain relief 5 are corresponding to the four grooves 162 of the lower shield part 16. Each recess 51 is used for supporting a cable 4 and receiving a portion of the ring 42 of the cable 4. The strain relief 5 defines three rectangular receiving slots 52 formed on top surface thereof and another three rectangular receiving slots 52 formed on bottom surface thereof The receiving slots 52 are cooperated with the positioning projections 158, 163 of the upper and lower shield part 15, 16. The strain relief 5 further defines three threaded through holes 53 respectively in alignment with the through holes 156 of the upper shield part 15 and three holes 161, 164 of the lower shield part 16 along an up-to-down direction for receiving a portion of the engaging means 9.

Referring to FIGS. 6 to 7 and in conjunction with FIG. 10, each of the latching member 6 is disposed in the receiving cavity 14 of the housing 1. Each of latching member 6 is stamped and formed from a metallic plate and comprises a vertical retaining portions 61, a connecting portion 62 extending forwardly from a bottom side of the retaining portions 61 and a latching portion 63 extending forwardly from the connecting portion 62. A front portion of the latch 6 is defined as a latching portion 63. The connecting portion 62 defines two foursquare openings 621 and a rectangular opening 622 disposed between two foursquare openings 621. The latching portion 63 defines a pair of barbs 631 formed at two sides thereof.

Referring to FIGS. 8 to 10, the pulling member 7 is made of insulative material and structured in a flat shape. The pulling member 7 defines an operating section 71 disposed in rear end thereof, two T-shaped actuating sections 73 disposed in a front end thereof and two paralleled connecting sections 72 connecting the operating section 71 to the two actuating sections 73. Each connecting section 72 defines a horizontal section 721 connecting to the operating section 71 and a curving section 722 connecting to the actuating section 73. The operating section 71 has a slit 711. A tape 74 is passed through the slit 711 and connected to the pulling member 7. The pulling member 7 also defines a cutout formed on the connecting section 72. Thus, the through hole 156 will not be shielded due to the cutout of the pulling member 7.

Figure 4:
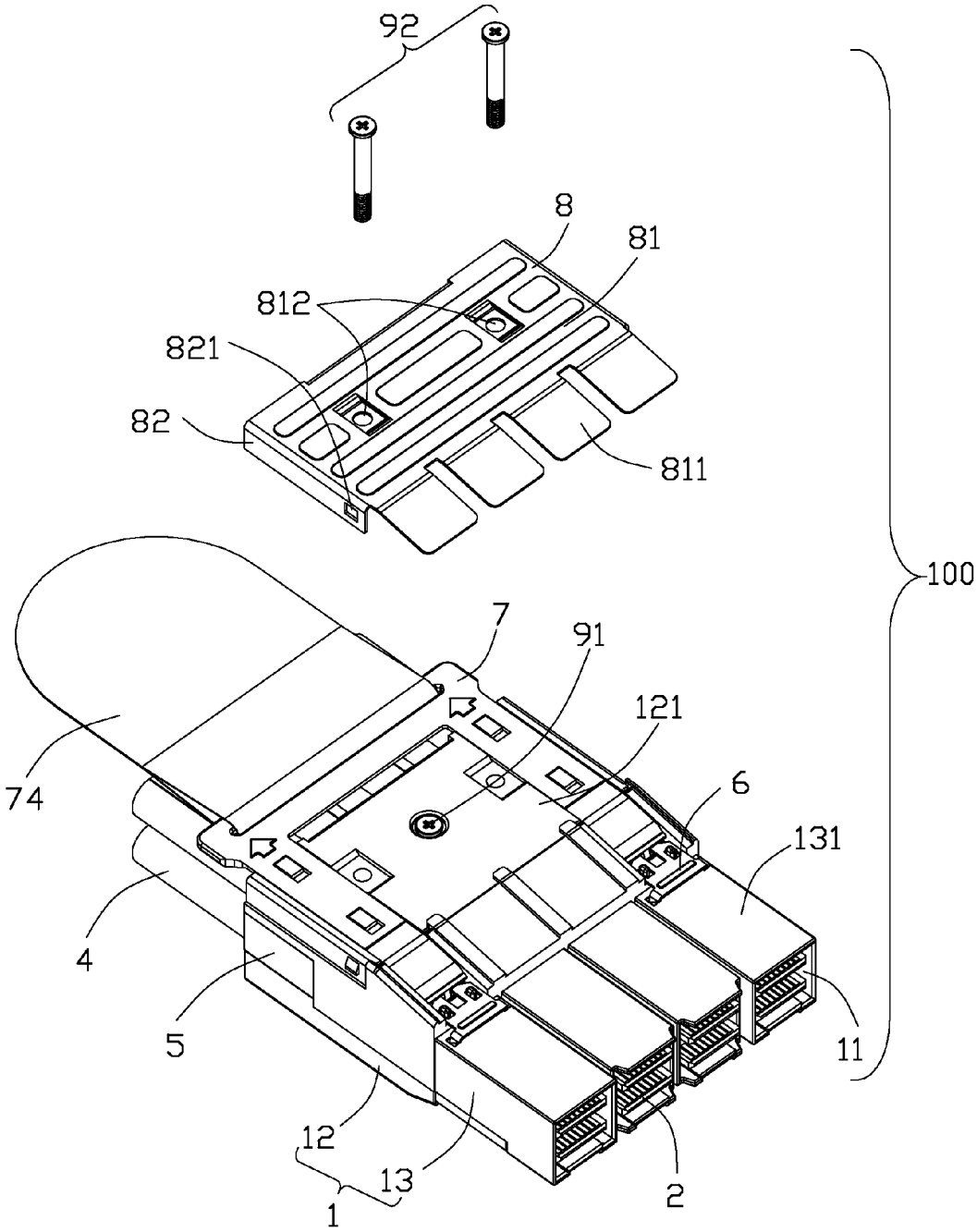
FIG. 4 is a partially assembled view of the electrical connector assembly of FIG. 1.
Figure 5:
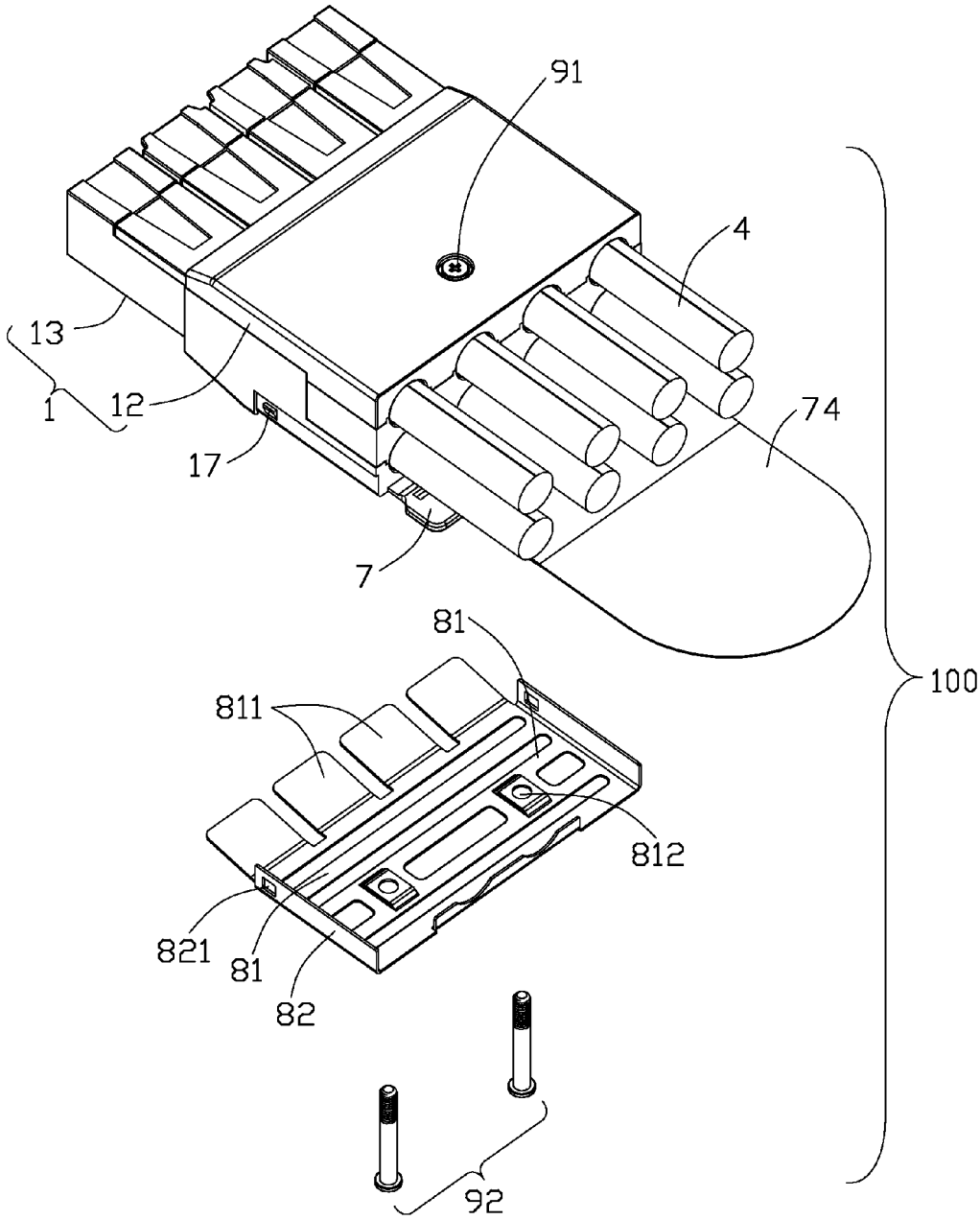
FIG. 5 is similar to FIG. 4, but viewed from another aspect.

Referring to FIGS. 4 to 5, the metallic shell 8 defines a top wall 81 for shielding a portion of the latch mechanism and a pair of side walls 82 extending downwardly from two sides of the top wall 81 for interlocking with the housing 1. The top wall 81 of the metallic shell 8 defines four inclined shielding pieces 811 and two holes 812 for engaging means 9 passing through. Each side wall 82 defines a hole 821 cooperating with the wedge-shaped projection 17 of the housing 1.

Referring to FIGS. 4 to 12 and in conjunction with FIG. 14, engaging means 9 comprises two first screws 91, and two second screws 92. The first screw 91 has a length longer than that of the second screw 92. Two first screws 91 are assembled to the housing 1 along two opposite directions and arranged in line along a vertical direction. Two first screws 91 are used for interconnecting the upper shield part 15, the lower shield part 16 and the strain relief 5 together. Two second screws 92 are assembled to the housing 1 along a same direction and disposed at two sides of the two first screws 91. Two second screws 92 are used for interconnecting the metallic shell 8, the upper shield part 15, the lower shield part 16 and the strain relief 5 together.

Referring to FIGS. 1 to 14, the assembling process of the electrical connector assembly 100 made in according to the present invention starts from soldering the conductors 41 of each cable 4 respectively to the terminating section 22 of each printed circuit board 2. Thus, eight combinations of the cable 4 and the printed circuit board 2 are formed.

After the eight cables 4 are respectively terminated to the eight printed circuit boards 2, then turning over the upper shield part 15 to make the cutout 152 and four passageways 153 facing upward. Then, assembling four combinations of the printed circuit boards 2 and the cables 4 respectively into the four passageways 153 through the cutout 152. Each of printed circuit board 2 is supported by the first positioning posts 154 of the upper shield part 15 along a vertical direction. And, the printed circuit board 2 is engaged with the upper shield part 15 along a front-to-rear direction due to the pair of slots 23 of the printed circuit board 2 cooperated with the pair of second positioning posts 155 of the upper shield part 15. And, a front end of each cable 4 is received into the groove 157 of the upper shield part 15. A portion of the ring 42 of the cable 4 is also received into the groove 157.

After four combinations of the cable 4 and the printed circuit board 2 are assembled to the upper shield part 15, then assembling a strain relief 5 to a rear end of the cutout 152 of the upper shield part 151. Three positioning projections 158 of the lower shield part 15 are received into the three receiving slots 52 of the strain relief 5. Thus, a preliminary position between the upper shield part 15 and the strain relief is achieved. And, each ring 42 of the cable 4 is received into a room formed by the upper shield part 15 and the strain relief 5.

After the strain relief 5 is assembled to the upper shield part 15, then assembling four spacers 3 to the four passageways 153 of the upper shield part 15. Each of the spacer 3 is positioned with the upper shield part 151 and located on the printed circuit board 2. The pair of second positioning posts 155 of the upper shield part 15 pass through the corresponding two grooves 33 of the spacer 3 along an up-to-down direction to limit a movement of each spacer 3 along a front to rear direction.

After four spacers 3 are assembled to the upper shield part 15, then assembling another four combinations of the printed circuit board 2 and cable 4 to the four passageways 153 of the upper shield part 15. Each of the printed circuit board 2 is engaged with the upper shield part 15 along a front-to-rear direction due to the pair of slots 23 of the printed circuit board 2 cooperated with the pair of second positioning posts 155 of the upper shield part 15. The ring 42 of each cable 4 has a portion received into a recess 51 of the strain relief 5.

Then assembling the lower shield part 16 to the upper shield part 15. Thus, the cutouts 12 of the upper shield part 15 are shielded by the lower shield part 16 along an up-to-down direction. The eight printed circuit boards 2 are also positioned in the housing 1 by the lower shield part 16 along an up-to-down direction. Through the above assembling steps, the eight printed circuit boards 2, a strain relief 5 and four spacers 3 are received into the housing 151.

After the lower shield part 16 is assembled to the upper shield part 15, then assembling the pair of latching members 6 to the pulling member 7 through following steps. Firstly, the pair of latching members 6 are disposed in front of the actuating section 73 of the pulling member 7 and arranged perpendicular to the pulling member 7. Secondly, each actuating section 73 of the pulling member 7 is passed through the rectangular opening 622 of the latching member 6 and located below the latching member 6. Thirdly, the pair of latching members 6 are rotated 90 degree to make the latching member 6 and the pulling member 6 in line. Thus, the pair of latching members 6 are respectively interconnected with the pulling member 7. And, each of the latching member 6 is not easily discrete from the pulling member 7 due to the width of the actuating section 73 is wider than a width of rectangular opening 622.

Then, assembling a pair of first screws 91 to the housing 1 along a vertical direction. One first screw 91 is assembled to the housing 1 from up to down to interconnected the upper shield part 15 and the strain relief 5. One first screw 91 is passed through the through hole 156 and received into the through hole 53. Another first screw 91 is assembled to the housing 1 from down to up to interconnected the lower shield part 16 and the strain relief 5. Another first screw 91 is passed through the through hole 161 and received into the through hole 53. Thus, the first shield part 15, the second shield part 16 and the strain relief 5 are interconnected with each other due to the pair of first screws 91.

Then, assembling the pair of latching members 6 and the pulling member 7 together to an exterior surface of housing 1. The two connecting sections 72 of the pulling member 7 are located on the first surface 121 of the body portion 12 of the housing 1. The curving section 722 of each connecting section 72 of the pulling member 7 is supported by the supporting portions 141 formed in the receiving cavity 14. The rear operating section 71 of the pulling member 7 extends rearwardly beyond the rear surface of the housing 1. In addition, each of the latching member 6 is received into a receiving cavity 14. Thus, the two retaining portions 61 of the latching member 6 are respectively received into the two slits 142 to make the latching member 6 positioned to the housing 1. The connecting portion 62 of the latching member 6 is located above the bottom surface 141 of the receiving cavity 14. The latching portion 63 extends forwardly and is located above the second surface 131 of the mating portion 13 of the housing 1. The latching portion 63 is cantilevered from the retaining portion 61. A tape 74 is passed through the slit 711 and connected to the pulling member 7. When a rearward pulling force is exerted on a rear end of the pulling member 7 or the tape 74, the latching portion 63 of the latching member 6 will be raised up. When the rearward pulling force is released, the latching portion 63 of the latching member 6 will resume to an original state.

Then, assembling a metallic shell 8 to the body portion 12 of the housing 1. The metallic shell 8 is engaged with the housing 1 due to the pair of holes 821 cooperating with the pair of wedge-shaped projections 17 of the housing 1. And, a portion of the latch mechanism is shielded by the metallic holder 8.

Finally, assembling two second screws 92 to the housing 1 to interlock the metallic shell 8, the upper shield part 15, the strain relief 5 and the lower shield part 16 together. It should be noted that each second screw 9 is assembled to the housing 1 along an up to down direction. Each second screw is passed through the through hole 161, 53 and received into the receiving hole 164. Thus, the first shield part 15, the lower shield part 16, the strain relief 5 and the metallic shell 8 are engaged with each other by the first and second screws 91, 92.

After the above assembling steps, the entire process of assembling of the electrical connector assembly 100 is finished. The electrical connector assembly 100 has a new mating surface to meet higher and higher data transmitting rate. On another aspect, a reliable latch mechanism is provided to an exterior surface of the housing. And, the housing 1 and the strain relief 5 are engaged with each other through the engaging means 9.

It will be understood that the invention may be embodied in other specific forms without departing from the spirit or central characteristics thereof The present examples and embodiments, therefore, are to be considered in all respects as illustrative and not restrictive, and the invention is not to be limited to the details given herein.

What is claimed is:

1. An electrical connector assembly, comprising:

a housing comprising a first shield part, a second shield part assembled with each other; the housing defines a body portion and a mating portion extending forward from the body portion for mating to a complementary connector; the body portion has a cross section larger than that of mating portion;

a plurality of receiving rooms are arranged side by side and spaced apart with each other; the body portion of the housing has a top surface defined as a first surface, the mating portion of the housing has a top surface defined as a second surface;

the first surface defines an inclined surface toward to the second surface;

the body portion defines a plurality of receiving cavities extending downwardly from the inclined surface for a distance and having a plurality of receiving rooms formed therein and spaced apart with each other; plural pairs of printed circuit boards (PCBs) are disposed in the housing; each pair of said printed circuit boards (PCBs) are received into a corresponding receiving room of the housing;

a plurality of spacers are disposed in the housing; each of spacers is received into a corresponding receiving room and sandwiched by two corresponding PCBs; a plurality of cables are respectively electrically connected with said plural pairs of printed circuit boards;

a pair of supporting portions are respectively formed on two inner side surfaces of each receiving cavity and used for supporting a portion of a pulling member;

a strain relief disposed in the housing and sandwiched by the first shield part and the second shield part;

a metallic shell engaged with the housing;

a pair of first screws assembled to the housing along two opposite directions and interlocked with first shield part, the second shield part and the strain relief; and a pair of second screws assembled to the housing along a same direction and interlocked the first shield part, the second shield part, the strain relief and the metallic shell.

2. The electrical connector assembly as recited in claim 1, wherein the electrical connector assembly further comprises at least one cable extending into the housing and electrically connected with the a rear end of the printed circuit board.

3. The electrical connector assembly as recited in claim 1, wherein the pair of first screws are arranged in line along a vertical direction.

4. The electrical connector assembly as recited in claim 1, wherein; a pair of wedge-shaped projections are formed on two sides of the body portion of the housing for engaging with the metallic shell.

5. The electrical connector assembly as recited in claim 1, wherein the electrical connector assembly further comprises a latch mechanism assembled to an exterior surface of the housing, the latch mechanism has a portion shielded by the metallic shell.

6. The electrical connector assembly as recited in claim 5, wherein the latch mechanism comprises a pair of latching members and a pulling member interconnected with each other.

7. The electrical connector assembly as recited in claim 6, wherein the pair of latching members are respectively operated in a lever manner when the pulling member is moveable in a horizontal direction.

8. The electrical connector assembly as recited in claim 6, wherein each of the first screw is short than each of second screw.

9. An electrical connector assembly comprising:

a housing defining a plurality of receiving cavities along a front-to-back direction defined by a first part and a second part which are assembled to each other, a front portion of the first part dimensioned larger than that of the second part in a height direction perpendicular to said front-to-back direction under condition said front portion of the first part and said front portion of the second part are stacked with each other, while a rear portion of the first part dimensioned similar to that of the second part in the height direction under condition that the rear portion of the first part is spaced from the rear portion of the second part with a strain relief therebetween in the height direction;

the second part defines a plurality of rectangular mating ports; the housing defines a plurality of receiving rooms formed therein and respectively throughout the housing along a front-to-rear direction;

the a plurality of receiving rooms are arranged side by side and spaced apart with each other; the body portion of the housing has a top surface defined as a first surface, the mating portion of the housing has a top surface defined as a second surface;

the first surface defines an inclined surface toward to the second surface;

the body portion defines a plurality of receiving cavities extending downwardly from the inclined surface for a distance and having a plurality of receiving rooms formed therein and spaced apart with each other; plural pairs of printed circuit boards (PCBs) are disposed in the housing; each pair of said printed circuit boards (PCBs) are received into a corresponding receiving room of the housing;

a plurality of spacers are disposed in the housing; each of spacers is received into a corresponding receiving room and sandwiched by two PCBs; a plurality of cables are respectively electrically connected with said printed circuit boards;

a pair of supporting portions are respectively formed on two inner side surfaces of each receiving cavity and used for supporting a portion of a pulling member;

a first type screw extends into all the rear portion of the first part, the strain relief and the rear portion of the second part;

a second type screw extends into both the rear portion of the first part and the strain relief without the rear portion of the second part; and a third type screw extends into both the rear portion of the second part and the strain relief without the rear portion for the first part.

10. The electrical connector assembly as recited in claim 9, wherein the latch mechanism comprises a pair of latching members and a pulling member interconnected with each other.

11. The electrical connector assembly as recited in claim 9, wherein the pair of first engaging devices are arranged in line along a vertical direction.

12. The electrical connector assembly as claimed in claim 9, further including a plurality of cables arranged in first and second levels, of which at the first level the cables are respectively sandwiched between the rear portion of the first part and the strain relief, and at the second level the cables are respectively sandwiched between the rear portion of the second part and the strain relief.

13. The electrical connector assembly as claimed in claim 9, wherein each of said receiving cavities receives a pair of printed circuit boards with a spacer sandwiched between in the height direction.

14. The electrical connector assembly as claimed in claim 9, further including a metallic shell cooperates with the housing to hold a pulling member therebetween in the height direction, wherein at least one of said first, second and third type extends therethrough.

15. The electrical connector assembly as claimed in claim 14, further including a plurality of latches actuated by the pulling member wherein an amount of the latches is less than that of the receiving cavities.

16. The electrical connector assembly as recited in claim 9, wherein the electrical connector assembly further comprises a metallic shell engaged to the housing and shielding a portion of the latch mechanism.

17. The electrical connector assembly as recited in claim 16, wherein the electrical connector assembly further comprises a pair of second engaging devices assembled to the housing and interlocked the metallic shell, the upper shield part, the lower shield part and the strain relief.

18. The electrical connector assembly as recited in claim 17, wherein each of the second screw is longer than each of first screw.

19. The electrical connector assembly as recited in claim 17, wherein the pair of second engaging devices are arranged at two sides of the pair of first screws.

* * * * *